US006925978B1

(12) United States Patent
Gerzseny et al.

(10) Patent No.: US 6,925,978 B1
(45) Date of Patent: Aug. 9, 2005

(54) TWO-STEP ROLLER FINGER CAM FOLLOWER HAVING ANGLED LOCK PIN

(75) Inventors: Joseph C. Gerzseny, W. Henrietta, NY (US); Andrew J. Lipinski, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/924,614

(22) Filed: Aug. 24, 2004

(51) Int. Cl.[7] ..... F01L 1/18
(52) U.S. Cl. ..... 123/90.39; 123/90.16
(58) Field of Search ..... 123/90.39, 90.16, 123/90.15, 90.37, 90.41, 90.43, 90.44, 90.45, 123/90.46, 90.47

(56) References Cited

U.S. PATENT DOCUMENTS 4,611,558 A * 9/1986 Yoshizaki et al. ..... 123/90.16
5,544,626 A * 8/1996 Diggs et al. ..... 123/90.16
6,318,318 B1 * 11/2001 Jahr ..... 123/90.16
6,755,167 B2 6/2004 Krieg et al.

* cited by examiner

*Primary Examiner*—Thomas Denion
*Assistant Examiner*—Zelalem Eshete
(74) *Attorney, Agent, or Firm*—Jimmy L. Funke

(57) ABSTRACT

A two-step roller finger follower for shifting between high-lift and low-lift valve modes includes a body having side members defining coaxially disposed shaft orifices, a pallet end, a socket end, a slider arm aperture, and a latch pin channel. The socket end is mountable to a lash adjuster, and the pallet end is matable with a valve stem. A slider arm for engaging a high-lift cam lobe is disposed in the aperture, is pivotably mounted to the body, and includes a slider tip for engaging a latch pin having a nose section. A spool-shaped roller is adapted to follow the surface motion of low-lift cam lobes. The axis of the latch pin intersects a radius extension of the slider arm at an angle of less than 180° such that the latch pin is prevented from accidentally locking the slider arm in its lost-motion position.

6 Claims, 2 Drawing Sheets

TWO-STEP ROLLER FINGER CAM FOLLOWER HAVING ANGLED LOCK PIN

TECHNICAL FIELD

The present invention relates to roller finger followers used for variable valve actuation in overhead cam type internal combustion engines, and more particularly to a roller finger follower wherein a locking pin is disposed at an angle to a radius of rotation of a slider arm pivotably mounted in a follower body.

BACKGROUND OF THE INVENTION

Roller Finger Followers (RFF) are widely used in overhead cam internal combustion engines to sequentially open and close the cylinder intake and exhaust valves. In a typical application, the RFF serves to transfer and translate rotary motion of a cam shaft lobe into a pivotal motion of the RFF to thereby open and close an associated valve.

It is known that, for a portion of the duty cycle of a typical multiple-cylinder engine, the performance load can be met by a functionally smaller engine having fewer firing cylinders, and that at low-demand times fuel efficiency can be improved if one or more cylinders of a larger engine can be withdrawn from firing service. It is also known that at times of low torque demand, valves may be opened to only a low lift position to conserve fuel, and that at times of high torque demand, the valves may be opened wider to a high lift position to admit more fuel. It is known in the art to accomplish this by de-activating a portion of the valve train or limiting the opening of one or more valves associated with pre-selected cylinders in any of various ways. One way is by providing a special two-step RFF having a variably latchable and de-latchable central slider arm which may be positioned for contact with a high lift lobe of the cam shaft. Such a two-step RFF typically is also configured with rollers disposed at each side of the slider arm for contact with low lift lobes of the cam shaft on either side of the high-lift lobe. Thus, the two-step RFF causes low lift of the associated valve when the slider arm of the RFF is in a de-latched or deactivated position, and high lift of the associated valve when the slider arm of the RFF is latched in an activated position to engage the high lift lobe of the cam shaft.

One such two-step RFF known in the art comprises a generally elongate body having a pallet end in contact with an axially movable valve stem and an opposing socket end in contact with a stationary pivot such as, for example, a hydraulic lash adjuster (HLA). A moveable and therefore deactivatable high lift slider is positioned central to the RFF body. Rollers are rotatably mounted on each side of the slider on a non-rotatable shaft fixed to the body. The rollers ride on narrow bearings, as for example needle bearings. End washers are used to rotatably fix the rollers and bearings to the shaft and to restrain the rollers and bearings from moving laterally on the shaft.

The width of the bearings in this prior art follower is limited to the width of the rollers themselves. Further, because the bearings are disposed outside the body side walls, the bearings are substantially shielded from flow of lubricating oil within the RFF body.

Another prior art two-step roller finger follower is disclosed in U.S. Pat. No. 6,755,167 B2, issued Jun. 29, 2004, the relevant disclosure of which is incorporated herein by reference. In this roller finger follower, an elongate body having first and second side members defines coaxially disposed shaft orifices. A pallet end and a socket end interconnect with the first and second side members to define a central slider arm aperture and a latch pin channel. The socket end is adapted to mate with a mounting element such as an hydraulic lash adjuster, and the pallet end is adapted to mate with a valve stem, pintle, lifter, or the like. A slider arm for engaging a high-lift cam lobe is disposed in the slider arm aperture and has first and second ends, the first end of the slider arm being pivotally mounted to one end of the body and the second end defining a slider tip for engaging an activation/deactivation latch. The latch pin is slidably disposed in the latch pin channel, the latch pin having a nose section for selectively engaging the slider tip. A spool-shaped roller comprising a shaft and opposed roller elements fixedly attached to ends of the shaft is rotatably disposed in the shaft orifices, the roller being adapted to follow the surface motion of a low-lift cam lobes. Preferably, the shaft is journalled in roller or needle bearings which extend between and through both the first and second shaft orifices, being thus exposed to normal copious oil flow through central regions of the RFF.

A drawback of this prior art roller finger follower is that the axis of the locking pin intersects the axis of the pivot pin for the slider; i.e., the motion of the locking pin is along an extension of a pivot pin and slider tip radius. Thus, the motion of the slider tip is substantially orthogonal to the path of the locking pin. This relationship necessitates that the locking pin extend from its supporting bore in order to engage the slider tip, thereby engendering a bending moment on the locking pin. Providing acceptable support for such bending moment requires that the locking pin have a relatively long bore and large diameter, thus increasing undesirably the size of the follower body and hence the overall follower assembly.

A further drawback of such a roller finger follower is that the locking pin can inadvertently engage the wrong side of the slider tip if the locking pin is commanded to move when the slider is fully depressed by the cam lobe, causing the follower to become locked in the full lost-motion position, which condition is highly undesirable.

It is a principal object of the present invention to eliminate the bending moment inherent in the prior art follower.

It is also an object of the invention to prevent inadvertent locking of a follower in the full lost-motion position.

SUMMARY OF THE INVENTION

Briefly described, a roller finger follower for use in conjunction with a cam shaft of an internal combustion engine comprises an elongate body having first and second side members defining coaxially disposed shaft orifices. A pallet end and a socket end interconnect with the first and second side members to define a slider arm aperture and a latch pin channel. The socket end is adapted to mate with a mounting element such as an hydraulic lash adjuster, and the pallet end is adapted to mate with a valve stem, pintle, lifter, or the like.

A slider arm for engaging a high-lift cam lobe is disposed in the slider arm aperture and has first and second ends, the first end of the slider arm being pivotally mounted via a pin to the pallet end of the body and the second end defining a slider tip for engaging an activation/deactivation latch pin. The latch pin is slidably and at least partially disposed in the latch pin channel, the latch pin having a nose section for extending from the channel to selectively engage the slider tip.

A spool-shaped roller comprising a shaft and opposed roller elements fixedly attached to the shaft is rotatably disposed in the shaft orifices, the rollers being adapted to follow the surface motion of a low-lift cam lobes. Preferably, the shaft is journalled in roller or needle bearings which extend between and through both the first and second shaft orifices.

The latch pin channel is formed in the follower body at an angle to the pivot pin axis (and hence to a radius of motion of the slider tip) of less than 180° such that the latch pin engages the slider tip non-orthogonally, which allows the force of the slider tip to be borne directly by a wall of the canted channel, thus eliminating any bending moment in the latch pin and permitting a reduction in latch pin diameter and length. The angle further prevents the latch pin from inadvertently engaging the slider tip when the slider is in full lost-motion position.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DESCRIPTION OF THE PREFERRED EMBODIMENT

Figure 1:
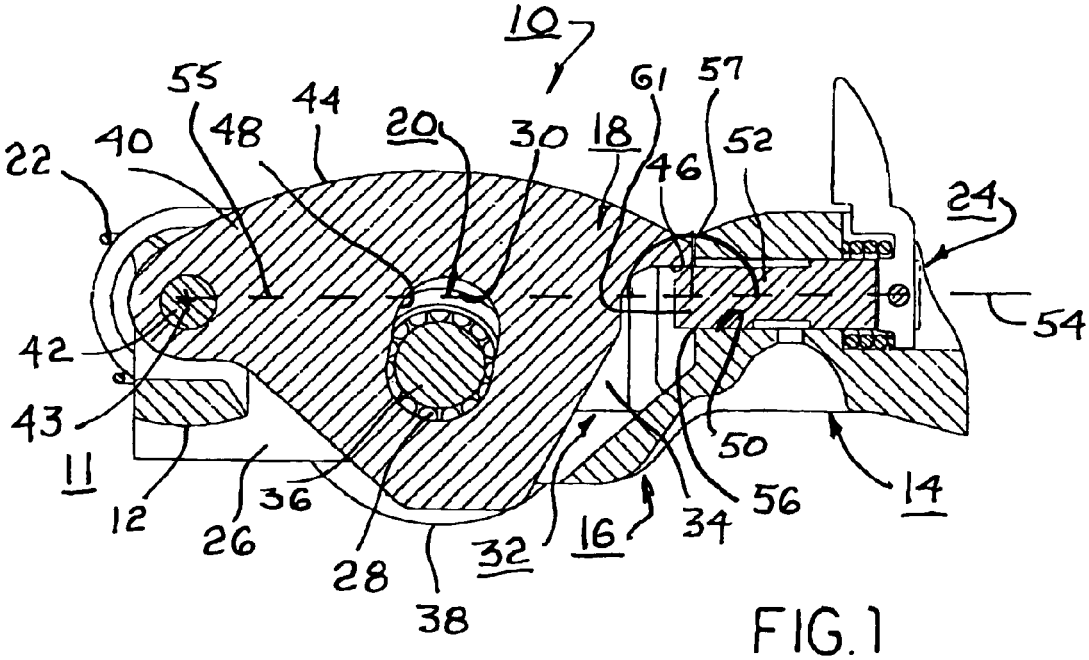
FIG. 1 (PRIOR ART)
FIG. 1 is a cross-sectional view of a prior art roller finger follower substantially as disclosed in U.S. Pat. No. 6,755,167 B2, showing the slider tip engaged by the latch pin.
Figure 2:
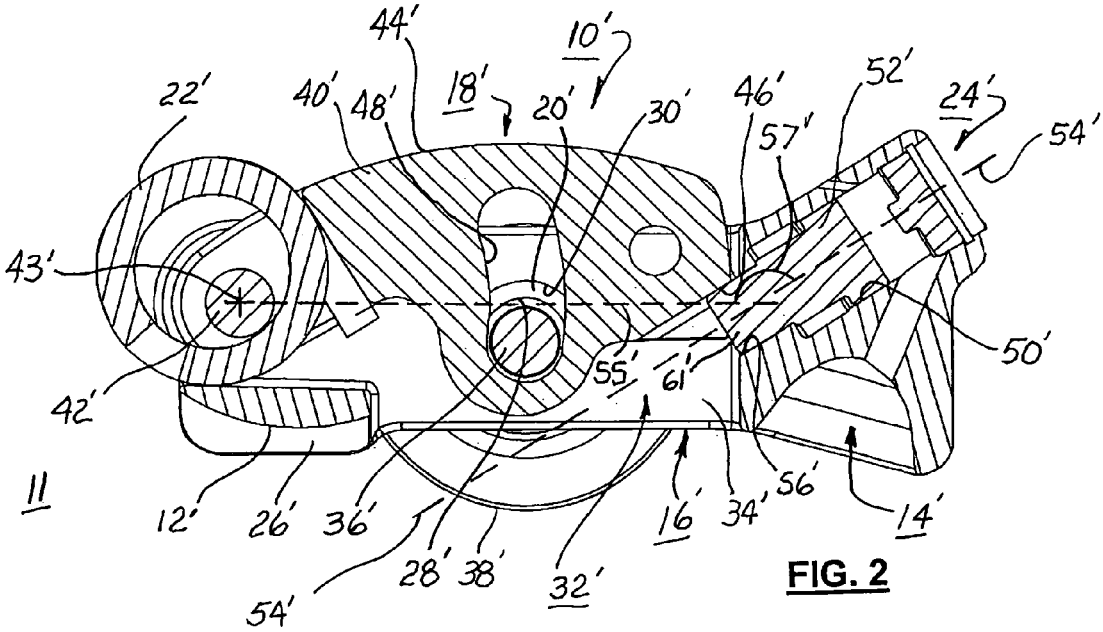
FIG. 2 is a cross-sectional view of an improved roller finger follower in accordance with the invention, showing an angled latch pin channel and latch pin, wherein the slider tip is engaged by the latch pin in high-lift mode.
Figure 3:
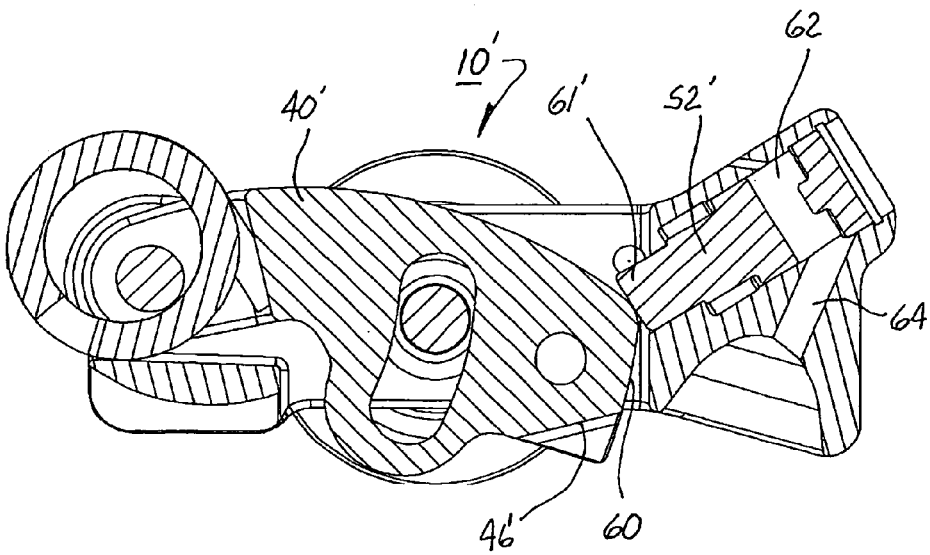
FIG. 3 is a cross-sectional view of the improved roller finger follower shown in FIG. 2, wherein the slider tip is disengaged from the latch pin in lost-motion (low-lift) mode.

Referring to FIGS. 1 through 3, prior art RFF 10 and improved RFF 10' are shown. Prior art RFF 10 is configured substantially as shown in incorporated U.S. Pat. No. 6,755,167, the details of which need not be repeated here. Sufficient detail, however, is provided to appreciate the improvement and benefit afforded by improved RFF 10' in accordance with the invention.

A roller finger follower such as RFF 10 or RFF 10' is intended for use with an internal combustion engine 11 comprising a camshaft configuration (shown in reference) having a central high-lift lobe flanked by a pair of low-lift lobes. The high lift lobe is either enabled, by latching of a central slider within the RFF, or disabled, by unlatching the central slider and allowing it to pivotably follow the high-lift lobe in lost motion.

As FIGS. 1 through 3 show RFF 10 and RFF 10' in longitudinal cross-section, some components and aspects are not shown, particularly those that are paired in the actual embodiments. Such pairings are indicated by *, and are fully disclosed in the incorporated reference.

For simplicity, the prior art and improved RFFs are discussed together in the following paragraphs wherein their construction is similar or identical. Following that, the novel differences are then disclosed independently.

Referring to FIGS. 1 and 2, a pallet end 12,12' of RFF 10,10' is provided for engaging a valve stem (shown in reference) and socket end 14,14' of RFF 10,10' is provided for engaging a pivot point such as the hemispherical head of a hydraulic lash adjuster (shown in reference). RFF 10,10' includes body assembly 16,16', slider arm assembly 18,18', spool roller assembly 20,20', lost motion springs* 22,22', and latch assembly 24, 24'.

Body assembly 16,16' includes elongate body 26,26' and roller bearings* 28,28' disposed in bearing orifices* 30,30'. Elongate body 26,26' includes a slider arm aperture 32,32' bounded by body side walls* 34,34' defining bearing orifices* 30,30' therethrough. The diameters of bearing orifices* 30,30' are sized to press-fittedly receive roller bearings* 28,28'. A cross-shaft 36,36' is rotatably disposed in bearings* 28,28' and is supportive of rollers* 38,38 on the ends thereof for following the low-lift cam lobes.

Slider arm assembly 18,18' includes slider arm 40,40' and slider shaft 42,42', having axes 43,43', for pivotably attaching arm 40,40' to body 26,26'. Slider arm 40,40' defines slider surface 44,44' for following the high lift cam lobe, slider tip 46,46', and elongated roller shaft clearance aperture 48,48'.

In improved RFF 10' as shown in FIGS. 2 and 3, return spring 22' is a torsion spring, although other means of biasing slider arm 40', such as a compression spring may be employed as desired.

The novel distinction between prior art RFF 10 and improved RFF 10' lies in the orientation of their respective latching assemblies 24,24'. Socket end 14,14' of body 26,26' defines a latch channel 50,50' for receiving a latch pin 52,52'. Channel 50,50' and latch pin 52,52' define a latch pin axis 54,54' and therefore a path along which the latch pin moves in engaging slider tip 46,46' to lock or unlock the slider between high and low lift positions.

In prior art RFF 10, latch pin axis 54 is substantially perpendicular to, and passes through, pivot pin axis 43. Thus axis 54 lies on a radius 55 of the rotational arc of slider arm 40 (i.e, axis 54 forms an included angle 57 of 180° with an extension of radius 55), causing slider tip 46 to be traveling in a direction substantially orthogonal to axis 54 at the point of engagement with latch pin 52. Because pin 52 must extend from channel 50 to form such engagement, a bending moment is created in nose portion 61 of latch pin 52 about the distal lip 56 of channel 50. Lip 56 cannot be extended to support pin 52 and eliminate the bending moment because it would then interfere with the lost motion travel of slider tip 46. As discussed previously, this relationship requires an undesirably long channel 50 to support pin 52 against the bending moment, and also allows for pin 52 to inadvertently engage slider tip 46 on surface 44 when the locking pin is commanded to move outward after the slider is fully depressed by the associated cam lobe, thereby undesirably locking the slider tip in the fully-depressed valve-deactivation position (not shown).

Referring now to FIGS. 2 and 3, in improved RFF 10', latch pin axis 54' does not pass through pivot pin axis 43' and thus does not lie on a radius 55' of the rotational arc of slider arm 40' (i.e, axis 54' forms an included angle 57' of less than 180° with an extension of radius 55'), causing slider tip 46' to be traveling in a direction substantially non-orthogonal to axis 54' at the point of engagement with latch pin 52'. This relationship allows pin 52' to be fully supported by lip 56' during engagement by slider tip 46', thus eliminating any bending moment in nose portion 61' of latch pin 52' without interfering with the lost motion travel of slider tip 46'. An additional benefit of the just-described relationship is that pin 52' cannot inadvertently lock the slider in the full lost-motion position.

Referring to FIG. 3, RFF 10' is shown in lost-motion position. Preferably, the outer end of slider 40' is formed as an arcuate surface 60 centered on pin axis 43', and tip 46' is placed low enough on surface 60 that latch pin 52' follows surface 60 throughout the motion of slider 40'. Thus, actuating latch pin 52' during the lost-motion cycle, as by providing pressurized oil to chamber 62 via oil passage 64, cannot cause the latch pin to lock the slider tip in the lost-motion position; and further, when the pressure is removed and the slider is returned to the high-lift position by spring 22', the latch pin snaps automatically into the high-lift lock position as shown in FIG. 2.

As described above, the novel distinction of this invention lies in the orientation of latch assembly 24 relative to slider assembly 18 and its pivotal axis 43. Therefore, while this invention has been described in reference to a spool type RFF, as shown in U.S. Pat. No. 6,755,167, the invention applies equally to other deactivation and multi-step RFFs including the prior art RFF having a non-rotatable roller shaft fixed to the body of the RFF, as described above.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A roller finger follower for use in conjunction with a cam shaft of an internal combustion engine, the camshaft having at least one first lobe and at least one second lobe, said roller finger follower comprising:

a) an elongate body including a first body end, a second body end, a slider arm aperture, and a latch pin channel;

b) a slider arm disposed in said slider arm aperture for engaging said first cam lobe and having a first end and a second end, said first end of said slider arm being mounted to said first body end for pivotal motion about a pivot axis, and said second end of said slider arm defining a slider tip;

c) at least one roller element element rotatably associated with said elongate body for engaging said second cam lobe; and d) a latch pin slidably disposed in said latch pin channel, said latch pin having a latch pin axis and having a nose section for selectively engaging said slider tip, wherein an extension of a radius of said slider arm from said pivot axis through said latch pin nose section intersects said latch pin axis at an included angle of less than 180 degrees.

2. A roller finger follower in accordance with claim 1 wherein said first cam lobe is a high-lift lobe and said second cam lobe is a low-lift lobe.

3. A roller finger follower in accordance with claim 1 wherein:

said elongate body further includes a first side member and a second side member, said side members defining coaxially disposed shaft orifices;

said at least one roller element includes two rollers operationally connected to a roller shaft, wherein said roller shaft is disposed in said shaft orifices.

4. A roller finger follower in accordance with claim 3 wherein said roller shaft is non-rotatably fixed to said elongate body.

5. A roller finger follower in accordance with claim 3 wherein said roller shaft is rotatably associated with said elongate body.

6. An internal combustion engine including a camshaft having high-lift and low-lift cam lobes, comprising a roller finger follower for selectively adjusting the lift of an associated engine valve, wherein said roller finger follower includes, an elongate body having a first side member and a second side member, said members defining coaxially disposed shaft orifices, a pallet end and a socket end interconnecting with said first and second side members to define a slider arm aperture, and a latch pin channel, a slider arm disposed in said slider arm aperture for engaging said high-lift cam lobe and having a first end and a second end, said first end of said slider arm being mounted to said pallet end of said body for pivotal motion about a pivot axis, and said second end defining a slider tip, a spool roller having a shaft and at least one roller element for engaging at least one of said low-lift cam lobes, said shaft of said spool roller being disposed in said shaft orifices, and a latch pin slidably disposed in said latch pin channel, said latch pin having a latch pin axis and having a nose section for selectively engaging said slider tip, wherein an extension of a radius of said slider arm from said pivot axis through said latch pin nose section intersects said latch pin axis at an included angle of less than 180 degrees.

* * * * *